US007022293B2

(12) United States Patent
Hogan

(10) Patent No.: US 7,022,293 B2
(45) Date of Patent: Apr. 4, 2006

(54) METHOD AND APPARATUS FOR PROCESSING A WASTE PRODUCT

(76) Inventor: Jim Smith Hogan, 1742 Country Club Dr., Sugar Land, TX (US) 77478-3906

( * ) Notice: Subject to any disclaimer, the term of this patent is extended or adjusted under 35 U.S.C. 154(b) by 204 days.

(21) Appl. No.: 10/602,123

(22) Filed: Jun. 23, 2003

(65) Prior Publication Data

US 2004/0084294 A1 May 6, 2004

Related U.S. Application Data

(62) Division of application No. 10/287,387, filed on Nov. 4, 2002, now Pat. No. 6,638,396.

(51) Int. Cl.
*B09B 3/00* (2006.01)
*C10B 57/16* (2006.01)

(52) U.S. Cl. ..... 422/184.1; 422/204; 422/233; 202/118; 202/131; 202/136

(58) Field of Classification Search ..... 422/204, 422/209, 233, 184.1; 202/118, 136, 131; 110/346, 250, 121.38; 588/201; 219/121.38
See application file for complete search history.

(56) References Cited

U.S. PATENT DOCUMENTS

| | | | | |
|---|---|---|---|---|
| 4,872,954 | A | 10/1989 | Hogan | 202/105 |
| 4,990,237 | A | 2/1991 | Heuer et al. | 208/13 |
| 5,005,494 | A * | 4/1991 | Schlienger | 110/341 |
| 5,078,836 | A * | 1/1992 | Hogan | 201/7 |
| 5,136,137 | A * | 8/1992 | Schlienger | 219/121.59 |
| 5,227,026 | A * | 7/1993 | Hogan | 202/117 |
| 5,269,906 | A | 12/1993 | Reynolds et al. | 208/13 |
| 5,523,060 | A * | 6/1996 | Hogan | 422/184.1 |
| 5,570,749 | A | 11/1996 | Reed | 175/66 |
| 5,736,031 | A | 4/1998 | Nye et al. | 208/340 |
| 5,809,911 | A * | 9/1998 | Feizollahi | 110/346 |
| 5,851,361 | A * | 12/1998 | Hogan | 202/136 |
| 5,927,970 | A * | 7/1999 | Pate et al. | 432/115 |
| 5,961,870 | A * | 10/1999 | Hogan | 219/679 |
| 6,120,650 | A | 9/2000 | Nye et al. | 196/116 |
| 6,250,236 | B1 * | 6/2001 | Feizollahi | 110/346 |
| 6,576,210 | B1 * | 6/2003 | Surma | 423/445 R |
| 6,606,855 | B1 * | 8/2003 | Kong et al. | 60/275 |
| 6,804,950 | B1 * | 10/2004 | Kong et al. | 60/275 |
| 6,817,388 | B1 * | 11/2004 | Tsangaris et al. | 141/82 |
| 2003/0024806 | A1 * | 2/2003 | Foret | 204/164 |

* cited by examiner

*Primary Examiner*—N. Bhat

(57) ABSTRACT

A method and apparatus for processing a waste product and producing a synthesis gas is provided. The system includes a sealed, heated rotatable drum for preheating and preparing the waste material suitable for a plasma reactor, and processing the material in the reactor. The synthesis gas created by the reactor is used to preheat the waste material by circulating the hot synthesis gas around the drum. In an alternative embodiment, the hot synthesis gas flows through the drum to preheat the waste material and to clean the synthesis gas. Different methods of cooling and cleaning the synthesis gas are used. The system may comprise two plasma reactors in combination with a rotating desorber drum.

30 Claims, 7 Drawing Sheets

METHOD AND APPARATUS FOR PROCESSING A WASTE PRODUCT

CROSS-REFERENCE TO RELATED APPLICATIONS

This application is a divisional of 10/287,387, filed Nov. 4, 2002, now U.S. Pat. No. 6,638,396.

STATEMENT REGARDING FEDERALLY SPONSORED RESEARCH OR DEVELOPMENT

Not applicable.

BACKGROUND OF THE INVENTION

1. Field of the Invention

The present invention relates generally to the field of processing a waste product and producing synthesis gas ("syngas") and useable solid products. More particularly, this invention relates to a method and apparatus for processing a waste product, secondary material, or other feedstock containing carbon by employing a heated rotatable drum and a plasma reactor.

2. Background of the Invention

A gasification system is generally defined as an enclosed thermal device and associated gas cleaning system or systems that does not meet the definition of an incinerator or industrial furnace, well known to those skilled in the art, and that: (1) limits oxygen concentrations in the enclosed thermal device to prevent the full oxidization of thermally disassociated gaseous compounds; (2) utilizes a gas cleanup system or systems designed to remove contaminants from the partially oxidized gas that do not contribute to its fuel value; (3) transforms inorganic feed materials into a molten, glass-like substance ("slag") at temperatures above 2000° F.; and (4) produces a synthesis gas.

Utilizing a plasma arc to gasify a material is a technology that has been used commercially for many years. Most plasma arc reactors produce a high quality syngas that can be used as a building block for other chemical manufacturing processes or as a fuel for energy production. Many feeds containing hydrocarbons, such as oil, coal, refinery residuals, and sewage sludge have all been successfully used in gasification operations. It is sometimes desirable to convert a hazardous stream of material into a useable product by gasifying the material. Upon gasification, the hazardous material, or feed, will typically be converted into a useable syngas and a useful molten material, or a molten glass-like substance called slag or vitreous frit. Since the slag is in a fused, vitrified state, it is usually found to be non-hazardous and may be disposed of in a landfill as a non-hazardous material, or sold as an ore, road-bed, or other construction material. It is becoming less desirable to dispose of waste material by incineration or desorption because of the extreme waste of fuel in the heating process and the further waste of disposing, as a residual waste, material that can be converted into a useful syngas and solid material.

Generally, the gasification process consists of feeding carbon-containing materials into a heated chamber (the gasifier) along with a controlled and limited amount of oxygen and steam. At the high operating temperature created by conditions in the gasifier, chemical bonds are broken by thermal energy and by partial oxidation, and inorganic mineral matter is fused or vitrified to form a molten glass-like substance called slag or vitreous frit. With insufficient oxygen, oxidation is limited and the thermodynamics and chemical equilibrium of the system shift reactions and vapor species to a reduced, rather than an oxidized state. Consequently, the elements commonly found in fuels and other organic materials end up in the syngas.

However, the carbon-containing feed materials may be difficult to manage because they are typically in an improper form for gasification. Furthermore, syngas produced by a plasma reactor is usually very hot, dirty, and difficult to manage. Therefore the industry would welcome a gasification system which is self-regulating, self-cleaning, and which produces a higher quality syngas and/or useable solid by-product.

The present invention overcomes certain deficiencies of the prior art.

BRIEF SUMMARY OF THE PREFERRED EMBODIMENTS

Disclosed is an apparatus and method for processing a waste stream wherein a heated, sealed rotatable drum preheats and prepares the waste stream for gasification within a plasma reactor. The synthesis gas (syngas) produced by the reactor is used to heat the rotatable drum and, consequently, cool the syngas. The syngas is a useable product and the molten metal, glass, and slag is useable or disposable as a non-hazardous material. The hot syngas may be blended with a colder gas and the blend used to preheat the feed. The hot syngas also may be conveyed through the inside of the rotating drum to cool and clean the gas, as well as to preheat the feed.

Another embodiment described herein includes a first plasma reactor to gasify the solid material in the feed, and a second plasma reactor to treat the untreated vapors, with the heat from the first reactor, or the second reactor, used to heat the rotating drum.

The disclosed devices and methods comprise a combination of features and advantages which enable them to overcome certain shortcomings of the prior art methods and apparatus. The various characteristics described above, as well as other features, will be readily apparent to those skilled in the art upon reading the following detailed description, and by referring to the accompanying drawings.

BRIEF DESCRIPTION OF THE DRAWINGS

For a detailed description of preferred embodiments of the invention, reference will now be made to the accompanying drawings in which.

NOTATION AND NOMENCLATURE

Figure 1:
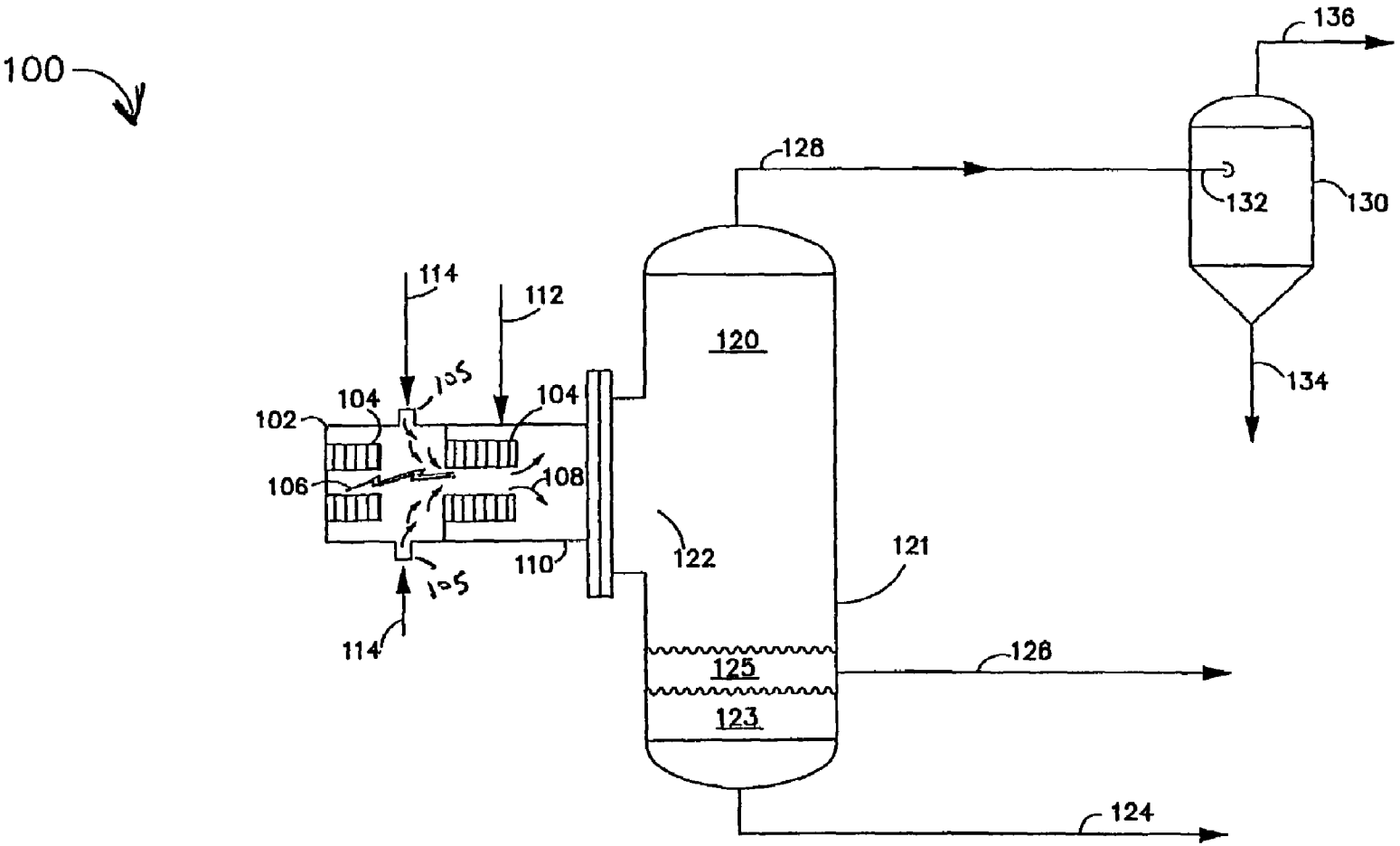
FIG 1 Prior Art
FIG. 1 shows a schematic view of a plasma reactor.

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ". Also, the terms "connects," "connected," and "interconnected" are intended to mean and refer to either an indirect or a direct connection between components or apparatus. Thus, for example, if a first apparatus "connects with" or is "connected to" to a second piece of equipment or apparatus, that connection may be through a direct connection of the two devices, such as by a conduit, or through an indirect connection via other devices, apparatus, conduits and other intermediate connections. As an even more specific example, a first apparatus may be connected to or interconnected with a second apparatus (by conduit or piping, for example) even where there is a third device or apparatus in between the two.

Further, the present invention is susceptible to embodiments of different forms. There are shown in the drawings, and herein will be described in detail, specific embodiments of the present invention, including an apparatus and method for processing a waste product so that it is converted into useable gases, liquids, and solids. This exemplary disclosure is provided with the understanding that it is to be considered an exemplification of the principles of the invention, and is not intended to limit the invention to that illustrated and described herein. In particular, various embodiments of the present invention provide a number of different constructions and methods of operation. It is to be fully recognized that the different teachings of the embodiments discussed below may be employed separately or in any suitable combination to produce desired results.

Reference to the term "waste" or "waste product" is intended to mean any feedstock which may contain carbon which will convert to syngas or other compounds which are desirable in the gas product or other elements which may contribute to the molten products. These feedstocks may be wastes, secondary materials, or raw materials for a manufacturing process. Further the term "syngas" means "synthesis gas" which is a gas manufactured by reforming compounds through conversion processes that involve thermal disassociation and partial oxidation. In the present invention, thermal disassociation and partial oxidation reactions occur between the waste feed and cooling mediums when subjected to a plasma arc. The resulting synthesis gas is commonly understood to be primarily composed of hydrogen and carbon monoxide, however, the composition of the gas produced in the presence of the plasma arc is not critical to the present invention. The gas may include any combination of elements or compounds present in the waste feed and/or cooling medium. To the extent that any term is not specially defined in this specification, the intent is that the term is to be given its plain and ordinary meaning as understood by a person of ordinary skill in the art.

DETAILED DESCRIPTION OF THE PREFERRED EMBODIMENTS

It is not intended to describe the complete operation of a plasma reactor, and the power supply used for powering and controlling the plasma torch of a plasma reactor, since a complete plasma reactor system, with power supply and controller, is known and can be purchased commercially. However, FIGS. 1 and 2 are simplified schematic drawings used to illustrate the basic operation of a typical plasma reactor.

Figure 2:
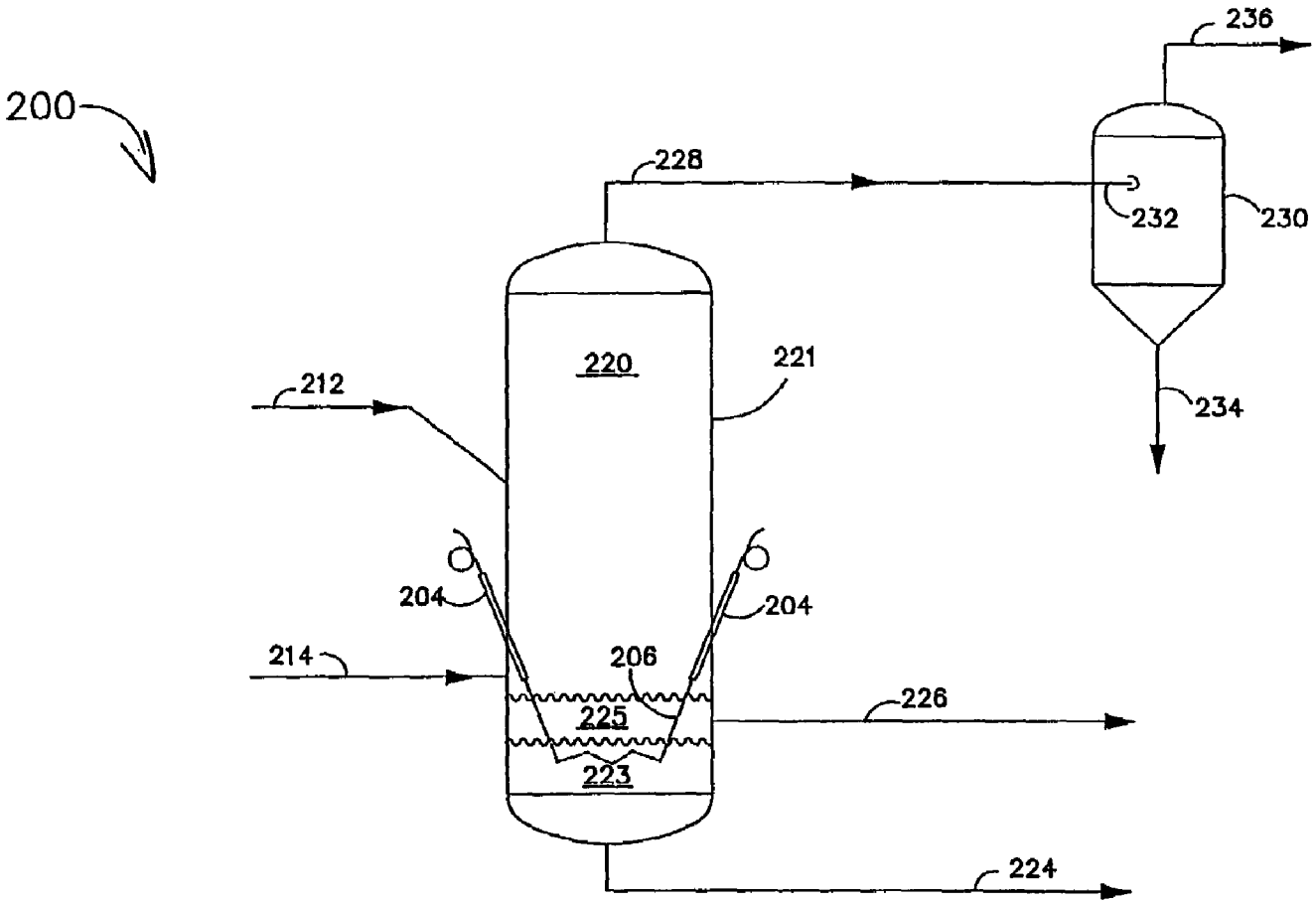
FIG 2 Prior Art
FIG. 2 shows a schematic view of an alternative plasma reactor.

The plasma reactor of FIG. 1 is referred to as reactor 100. Plasma torch 102 is provided with electrodes 104 that, when energized, produce arc 106. Plasma torch reforming and cooling medium 114, which is usually a controlled combination of air, steam, and/or oxygen, is injected to the inside of the torch via inlets 105 as shown by FIG. 1. When the reforming and cooling medium 114 contacts arc 106, plasma 108 is produced that flows to the contacting chamber 110, where the feed that is to be reformed 112 is injected and contacted by the plasma 108. Plasma 108 is an ionized, conductive gas which is created by the interaction of a gas with the electric arc. Plasma 108 is at a controlled temperature, usually from 8,000° F. to 30,000° F.

The molecules in the feed 112 that can be gasified are disassembled to their basic atoms and certain of the metals are melted. These atoms flow to collecting chamber 121 through opening 122 and reach a temperature, usually from 2000° F. to 3000° F., in collecting chamber 121. The molten metals and glass 123 collect in the bottom of the collecting chamber and are drawn off through outlet 124. The silicate slag 125 floats on top of molten metals 123 and is drawn off through outlet 126, as shown in FIG. 1. At the lower temperature in collecting chamber 121, the higher reactive atoms recombine and form the synthesis gas or syngas 120. For example, one carbon atom combines with an oxygen atom and forms a carbon monoxide molecule (CO). The quantity of oxygen injected with feed 112 and reforming and cooling medium 114 is controlled since excessive oxygen combines with the carbon monoxide molecules and forms carbon dioxide ($CO_2$). Accordingly, the elements commonly found in the feed (C, H, O, S, CL) end up in the syngas 120 as CO, $H_2$, $H_2O$, $CO_2$, $N_2$, $CH_4$, $H_2S$, HCL with lesser amounts of COS, $NH_3$, HCN, elemental carbon and trace quantities of other hydrocarbons.

Syngas 120 in chamber 121 flows through outlet 128 of container 121 and to cyclone 130 through cyclone inlet 132. Solids flow out bottom outlet 134 and cleaned syngas flows out top outlet 136. The operation of a cyclone is well known by those familiar with the art.

Referring now to FIG. 2, a simplified schematic drawing can be seen depicting the basic operation of another version of a plasma reactor. The plasma reactor of FIG. 2 is referred to as reactor 200. The plasma torch of reactor 200 is provided with electrodes 204 that, when energized, produce arc 206. Plasma torch reforming and cooling medium 214 flows to chamber 221 as shown by FIG. 2. When the reforming and cooling medium 214 contacts arc 206, plasma is produced within chamber 221. Some reactors having special graphite electrodes which may not require a cooling medium. As feed 212 enters chamber 221, the molecules of feed 212 are disassembled to their basic atoms. The molten metals and glass 223 collect in the bottom of collecting chamber 221 and are drawn off through outlet 224. The silicate slag, aluminates, and other salts 225 float on top of molten metals and glass 223, and are drawn off through outlet 226. The higher reactive atoms recombine and form the syngas 220 which flows through outlet 228 of chamber 221 to inlet 232 of cyclone 230. Solids collected by the cyclone, mostly carbon, flow out bottom outlet 234 of cyclone 230 and syngas flows out the top outlet 236.

Figure 3:
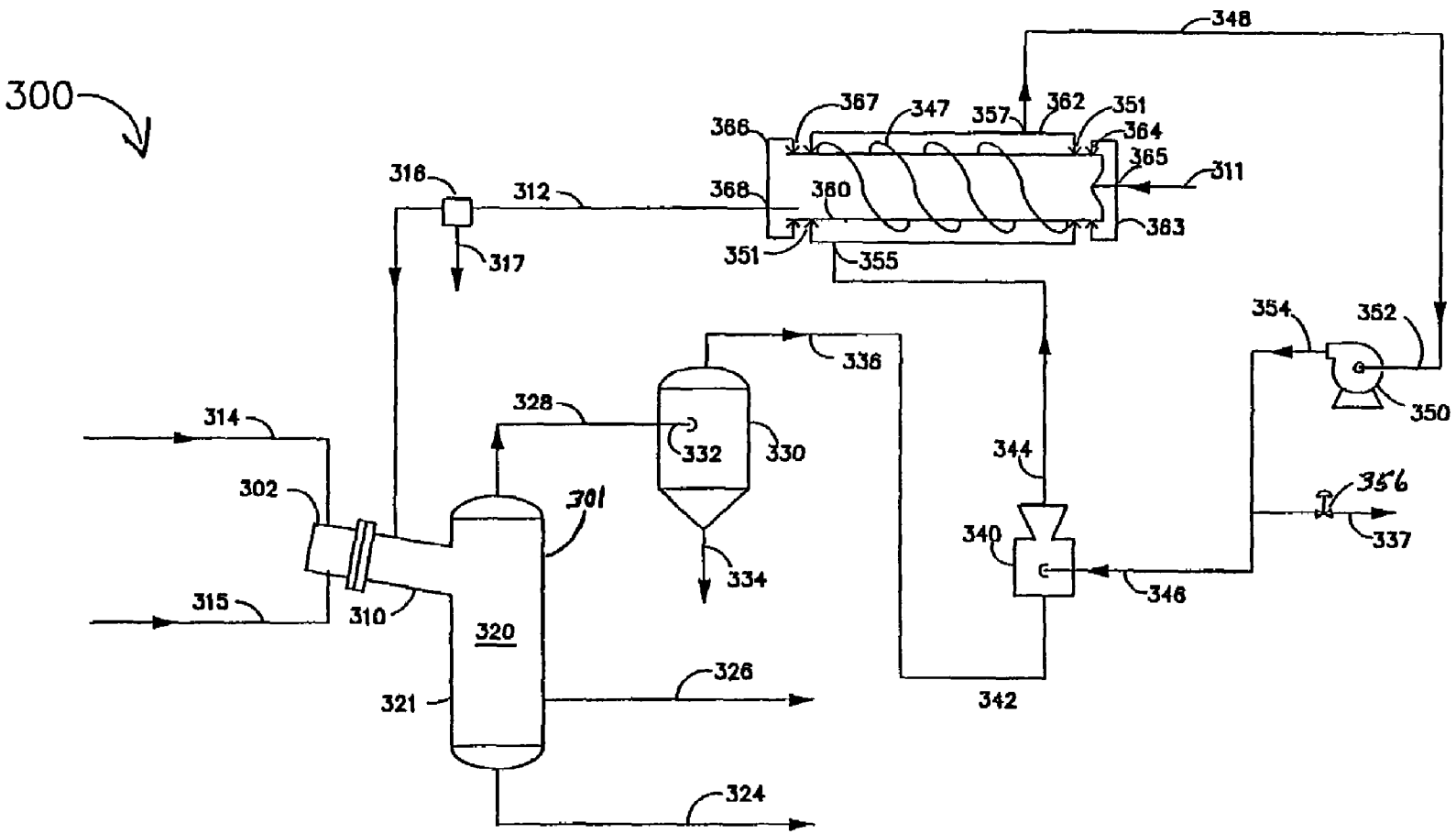
FIG. 3 shows a schematic view of a waste processing plant using a rotating drum in combination with a plasma reactor.

Referring next to FIG. 3, a process plant 300 incorporating a plasma reactor 301 is shown. The apparatus processes waste product and produces useful products including syngas, molten metals, and silicate slag that can be used for various types of construction or building material.

As shown in FIG. 3, process plant 300 includes a plasma reactor 301, such as the previously described reactors of FIGS. 1 and 2. Reactor 301 comprises a collecting chamber 321, a contacting chamber 310, and a plasma torch 302 with attached cooling and reforming medium supply 314 and electric supply 315. Molten metal flows out the bottom outlet 324 of chamber 321; silicate slag flows out outlet 326; and syngas 320 flows out top outlet 328. Syngas 320 then flows through inlet 332 of cyclone 330. Subsequently, separated solids flow out outlet 334 of cyclone 330 and clean syngas flows out top outlet 336. Syngas 320 then flows through inlet 342 of venturi exhauster 340, which is known to those skilled in the art and is commercially available. Syngas 320 flows out outlet 344 to the inlet 355 of outside enclosure 362 of rotating drum 360.

Plant 300 also includes rotatable drum 360. The operation of rotating drum 360, as well as other features and details of drum 360, is described in the following patents, which are hereby incorporated herein by reference: U.S. Pat. No. 5,078,836 entitled "Method and Apparatus for Retorting Material," U.S. Pat. No. 5,227,026 entitled "Retort Heat Exchanger Apparatus," and U.S. Pat. No. 5,523,060 entitled "Apparatus for Retorting Material." Thus, rotating, mounting, and other means associated with drum 360 are not described herein because the components and operation of rotating drum 360 is sufficiently disclosed in the above-referenced patents.

Drum 360 is attached to stationary inlet bulkhead 363 by seals 364 and attached to stationary outlet bulkhead 366 by seals 367. Seals 364 and 367 separate the inside of the drum from the outside. The drum is configured such that feed 311 placed through the inlet bulkhead opening 365 progresses through the drum to the outlet opening 368. Drum 360 is enclosed by stationary enclosure 362 and attached to drum 360 by seals 351. Enclosure 362 is provided with hot syngas 320 via gas inlet 355 and gas outlet 357 so that hot syngas 320 flows from the inlet to the outlet as shown by curves 347, thereby heating drum 360.

Material to be processed 311 flows into rotating drum 360 and is heated by the hot syngas 320 that flows between the outside of drum 360 and the inside of drum enclosure 362 as shown by flow arrows 347. In flowing through the rotating heated drum, the waste 311 is ground to a fine powder and most of the liquids are vaporized, thereby transforming material 311 into a prepared plasma feed. Prepared plasma feed 311 flows out bulkhead outlet 368 to plasma contacting chamber 310 through chamber conduit and inlet 312. Sorter 316, an apparatus for sorting and removing particles that are too large to be processed by the reactor, may optionally be placed in conduit 312. Particles that are too large may be removed through line 317 and or returned to inlet line 311 or otherwise processed.

Syngas 320 flows from collecting chamber 321 out outlet 328 through cyclone 330, venturi exhauster 340, and drum enclosure 362 as previously described. Syngas 320 then flows through conduit 348 to inlet 352 of recirculation blower 350. Syngas 320 flows from outlet 354 of blower 350 to driving fluid inlet 346 of exhauster 340. Recirculation blower 350 is used to increase the flow of gas around drum 360, thereby improving the heat transfer rate. Exhauster 340 is used to blend the hot syngas 320 coming from reactor 301 with the cooler syngas 320 coming from drum 360 so as to obtain a more manageable temperature such as, for example, between 800° F.–2000° F. Excess syngas 320 is drawn off selectively from outlet 354 by stream 337, which is controlled by control valve 356. Control valve 356, well known by those familiar with the art, is usually controlled by the desired temperature of prepared feed 312 before feed 312 enters mixing chamber 310.

After being processed by rotating heated drum 360, the prepared feed 312 consists of vapors and pulverized solids. It is necessary to pulverize the solids since the plasma reactor 301 is unable to process lumps or larger pieces of solids. The above referenced and incorporated patents teach how the rotating drum 360 is used to pulverize the solids.

Figure 4:
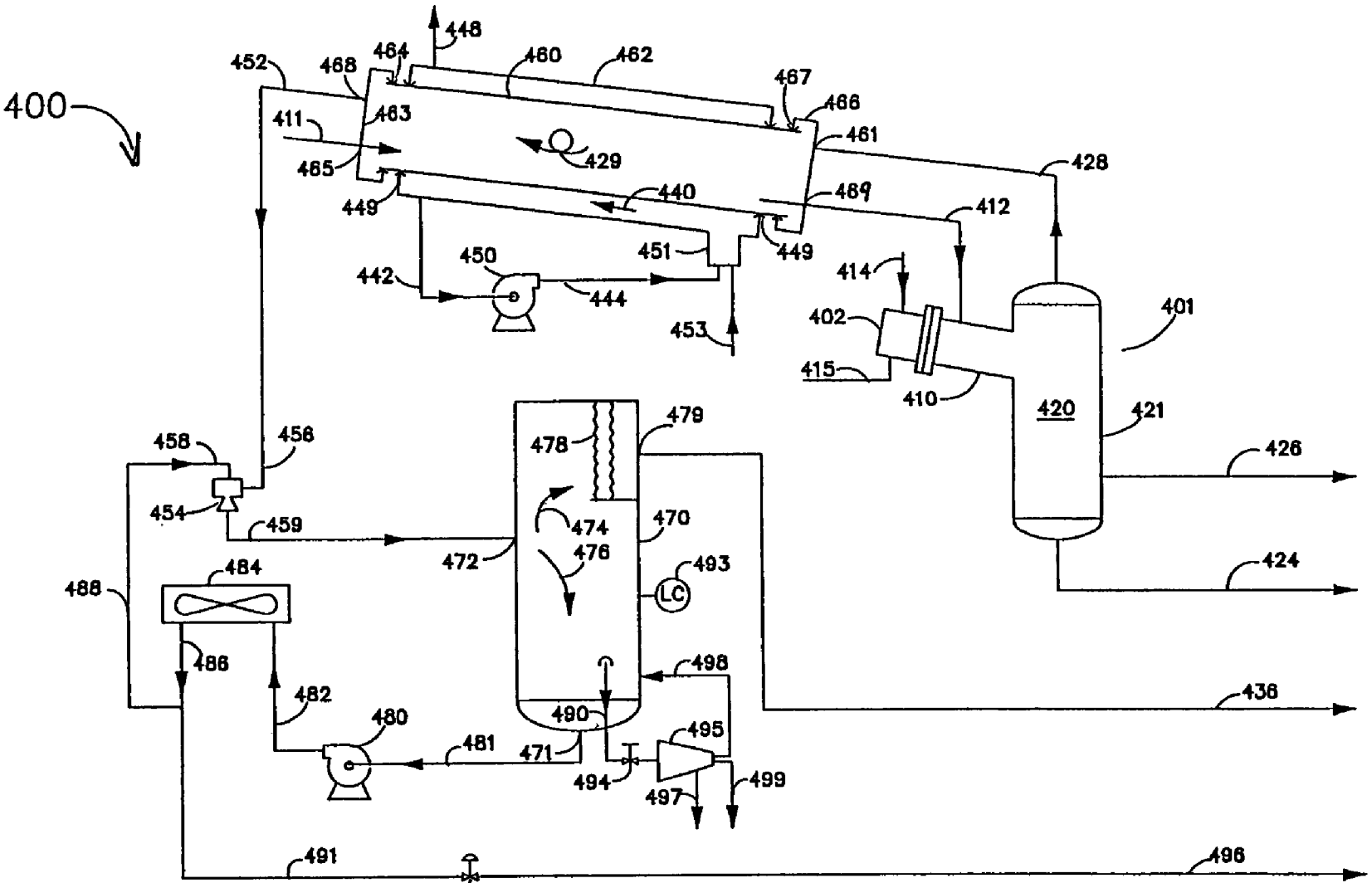
FIG. 4 shows a schematic view of an alternative waste processing plant using a rotating drum in combination with a plasma reactor.

Referring now to FIG. 4, a schematic drawing illustrates another embodiment of the present invention combining a waste processing drum with a plasma reactor. The embodiment of FIG. 4 may be preferred because it is more economical than the embodiment of FIG. 3, depending mainly on the composition of the unprepared feed. For example, in treating a feed containing a high percentage of condensables, such as water or light hydrocarbons that do not need to be processed by the plasma reactor, the embodiment of FIG. 4 may be preferred over that of FIG. 3.

The apparatus of FIG. 4 is referred to as process plant 400. Plant 400 includes rotatable drum 460 which is attached to stationary inlet bulkhead 463 by seals 464 and attached to stationary outlet bulkhead 466 by seals 467. Seals 464 and 467 separate the inside of drum 460 from the outside. Drum 460 is configured such that unprepared feed 411 placed through the inlet bulkhead opening 465 progresses through the drum to the outlet opening 469.

Plasma reactor 401 comprises a collecting chamber 421, a contacting chamber 410, and a plasma torch 402 with attached cooling and reforming medium supply 414 and electric supply 415. Molten metal flows out the bottom outlet 424 of chamber 421; silicate slag flows out outlet 426; and syngas 420 flows out top outlet 428. Syngas 420 flows through inlet 461 of bulkhead 466. Syngas 420 then flows through the inside of drum 460 to the outlet opening 468 of bulkhead 463. In flowing through drum 460, the hot syngas 420 is cooled and the feed 411 is heated, vaporizing all of the water and light constituent portions of feed 411. Drum 460 is also provided with outer shell 462 having seals 449.

Material to be processed 411 flows through the inside of rotating drum 460, and is heated by the hot syngas 420 which also flows through drum 460 as shown by flow arrow 429. After being processed by drum 460, materials to be processed 411 exit drum 460 via outlet 469 of bulkhead 466 as prepared feed 412. Syngas 420, as well as other vapors vaporized from the feed 411, exits drum 460 via outlet 468 of bulkhead 463. This exit stream 452 flows to inlet 456 of venturi scrubber 454. Hot streams, such as stream 452, sometimes contain large hydrocarbon molecules which vaporize in the drum, but which also may condense and foul the conduit out of the drum. Therefore, an external rotatable auger with seal (not shown) may be installed somewhere along the stream 452 conduit which can drill and clean the conduit in a few seconds, without the need to shut down plant 400.

Syngas 420 flows from outlet 459 of venturi 454 to scrubber inlet 472 of scrubber 470. Scrubber 470 contains demister element 478, well known by those familiar with the art. Syngas 420 flows up the inside of scrubber 470, as shown by arrow 474, through demister 478, and out outlet 479 to become product stream 436. The liquid elements flow down the inside of scrubber 470, as shown by arrow 476, and out the bottom outlet 471 to the inlet 481 of pump 480. After passing through pump 480, the liquid elements flow out pump outlet 482, then through air cooler 484 and out air cooler outlet 486. The liquid stream is then divided into venturi driving stream 488 that goes to venturi driving inlet 458 and stream 491 that goes to liquid disposal stream 496. The flow of stream 496 is controlled by control valve 492 which, in turn, is controlled by level controller 493.

The liquid in the bottom of scrubber 470 contains some hydrocarbons and solids. Side stream 490 may be drawn off and controlled by hand control valve 494, and centrifuged by centrifuge 495. The solids stream 497 and the hydrocarbon stream 499 flow out of centrifuge 495, as shown, and the water stream 498 is returned to the scrubber.

Recirculation blower 450, burner 451, and fuel and oxygen supply line 453 all assist in providing optional startup and/or additional heat to drum 460. Burner 451 may optionally supply heat to the drum during startup and operation. When burner 451 is used, blower 450 recirculates hot gas from shell 462 via inlet 442 to burner 451 via outlet 444 as shown by arrow 440. Exhaust gas flows to the atmosphere by exhaust stack 448.

Figure 5:
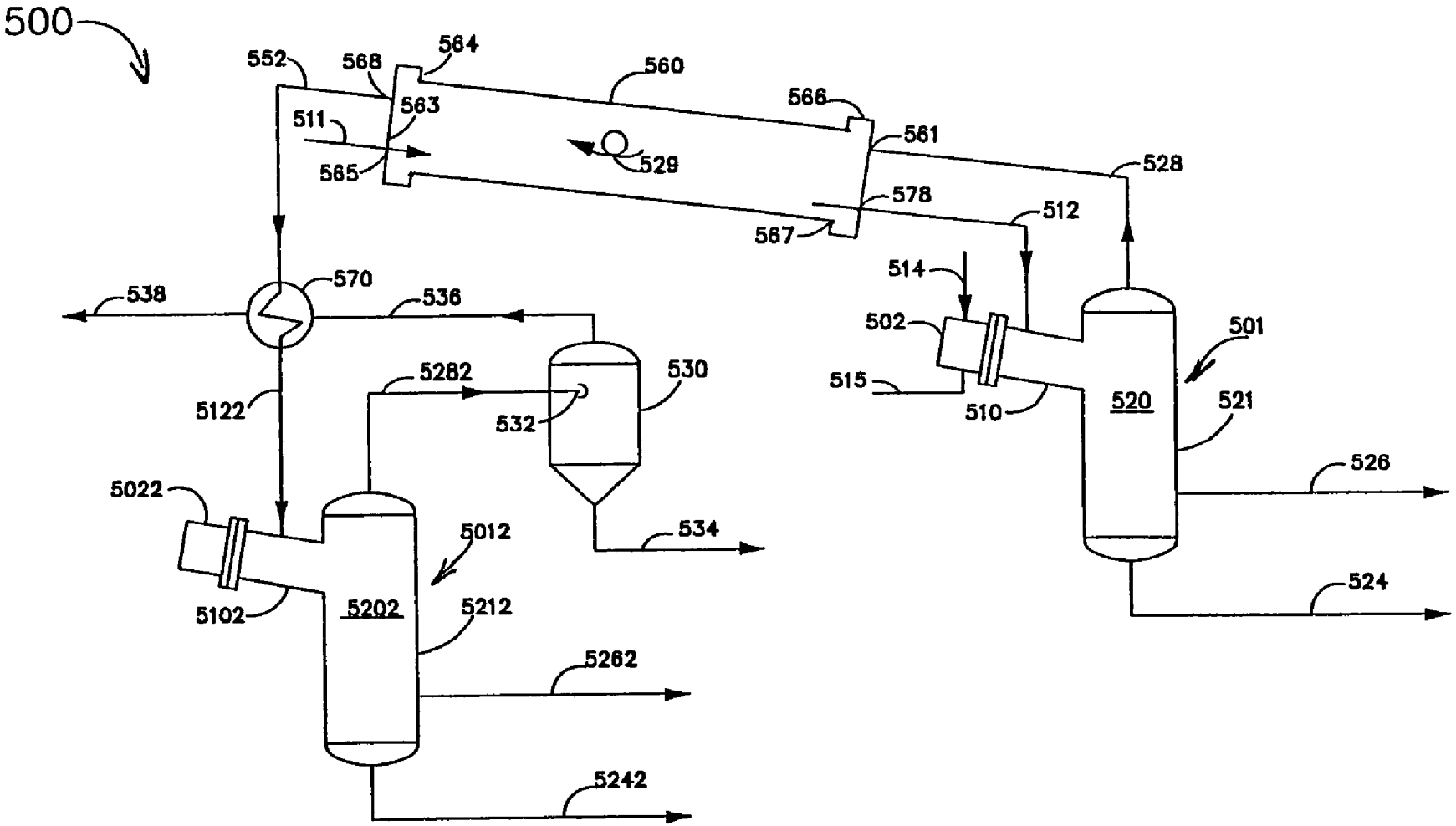
FIG. 5 shows a schematic view of a waste processing plant using a rotating drum in series with two plasma reactors.

Referring to FIG. 5, a schematic drawing shows a further embodiment of the present invention. The apparatus of FIG. 5 is referred to as process plant 500. Plant 500 includes rotatable drum 560 that is attached to stationary inlet bulkhead 563 by seals 564 and attached to stationary outlet bulkhead 566 by seals 567. Seals 564 and 567 separate the inside of drum 560 from the outside. The drum is configured by sloping the drum and/or having internal baffles (not shown) that lift and push the feed forward, as taught by the above-referenced and incorporated patents, such that feed 511 placed through the inlet bulkhead opening 565 progresses through the drum to the outlet opening 578, yet hot gas flowing through nozzle 561 flows back through the drum to outlet 568.

Plant 500 also includes a plasma reactor 501. Reactor 501 comprises collecting chamber 521, contacting chamber 510, and plasma torch 502 extending from contacting chamber 510 and including inlets for a cooling and reforming medium supply 514 and electric supply 515. Molten metal flows out the bottom outlet of chamber 521 through outlet 524; silicate slag flows out outlet 526; and syngas 520 flows out top outlet 528. Syngas 520 flows through inlet 561 of bulkhead 566. Syngas 520 then flows through the inside of drum 560 to the outlet opening 568 of bulkhead 563. While flowing through drum 560, hot syngas 520 is cooled and the unprepared feed 511 is heated, vaporizing the water and light constituents.

Feed 511 flows through the inside of rotating drum 560 and is heated by hot syngas 520 that flows through the drum as shown by flow arrow 529, thereby forming prepared feed stream 512. Syngas 520, as well as other vapors vaporized from the feed, referred to as exit stream 552, then flows out outlet 568 of bulkhead 563 and into cross exchanger 570. Cross exchanger 570 preheats stream 552, converting it to preheated stream 5122, which then flows to contacting chamber 5102 of plasma reactor 5012, the second plasma reactor included in plant 500. Plasma reactor 5012 comprises collecting chamber 5212, contacting chamber 5102, and plasma torch 5022 extending from contacting chamber 5102 and having inlets for an electric power supply and a supply of reforming and cooling medium, not shown but similar to those of reactor 501. Collecting chamber 5212 contains molten metal outlet 5242, slag outlet 5262, and syngas outlet 5282. Syngas 5202 flows from the collecting chamber 5212 to inlet nozzle 532 of cyclone 530. The solids collected by cyclone 530 flow out nozzle 534 and clean syngas flows out nozzle 536 and then through cross exchanger 570 to become a cooler syngas stream 538.

Figure 6:
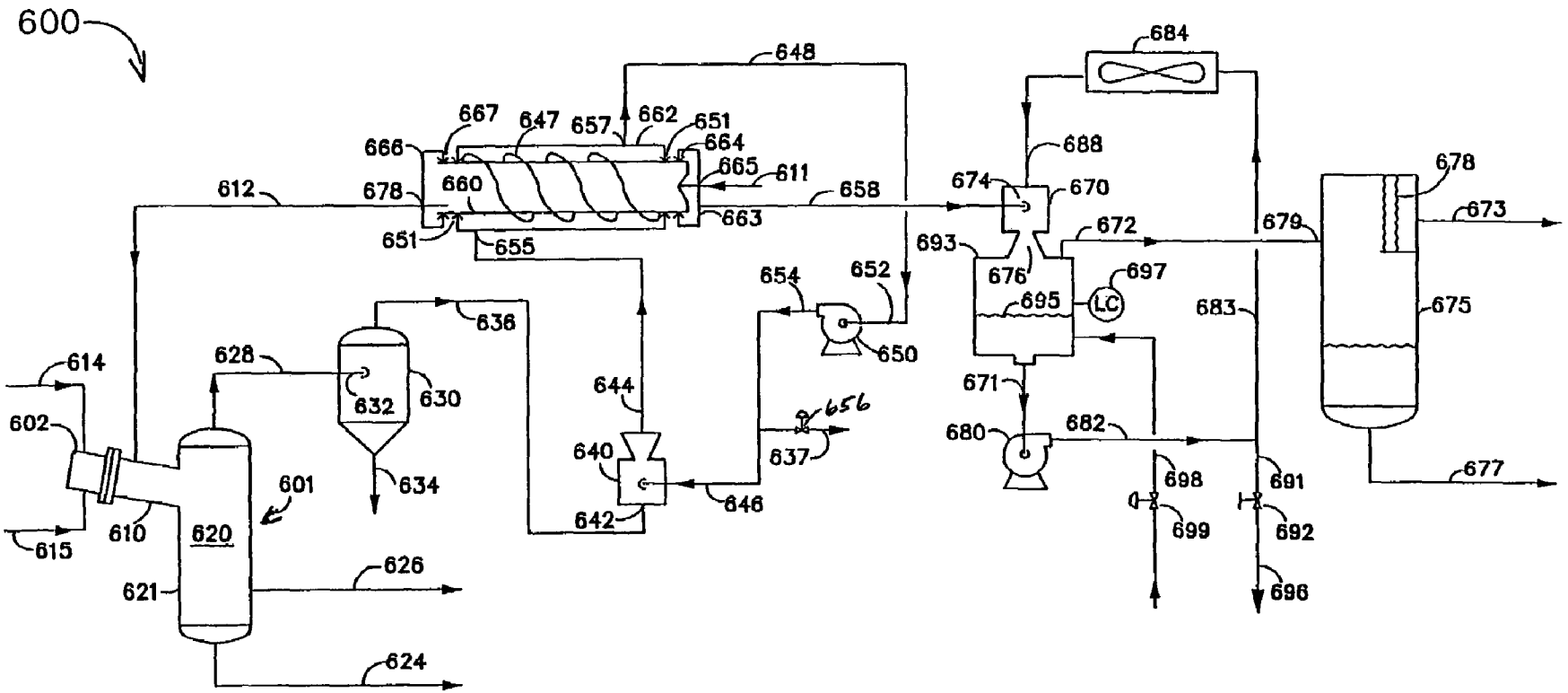
FIG. 6 shows a schematic view of another version of a waste processing plant using a rotating drum in combination with a plasma reactor that gasifies only the solids and high boilers that process the waste.

FIG. 6 is a schematic drawing of yet another embodiment of the present invention. The apparatus of FIG. 6 is referred to as process plant 600. Plant 600 includes a plasma reactor 601. Reactor 601 comprises a collecting chamber 621, a contacting chamber 610, and a plasma torch 602 extending from contacting chamber 610 and having inlets for a cooling and reforming medium supply 614 and electric supply 615. Molten metal flows out the bottom outlet 624 of chamber 621; silicate slag flows out outlet 626; and syngas 620 flows out top outlet 628. Syngas 620 flows through inlet 632 of cyclone 630, with separated solids then flowing out outlet 634 of cyclone 630 and clean syngas flowing out top outlet 636. Syngas 620 then flows through inlet 642 of venturi exhauster 640 and through outlet 644 to the inlet 655 of outside enclosure 662 of rotating drum 660.

Plant 600 also includes rotatable drum 660. Drum 660 is attached to stationary inlet bulkhead 663 by seals 664 and attached to stationary outlet bulkhead 666 by seals 667. Seals 664 and 667 separate the inside of drum 660 from the outside. Drum 660 is configured such that feed 611 placed through the inlet bulkhead opening 665 progresses through the drum to the solids outlet opening 678, and the vapors and gases produced inside of the heated and rotating drum 660 flow out the vapor outlet 658 of inlet bulkhead 663. Drum 660 is enclosed by stationary enclosure 662 and attached by seals 651. Enclosure 662 is provided with hot gas inlet 655 and hot gas outlet 657 so that hot gas flows from the inlet to the outlet as shown by curves 647 and heats the drum.

Feed 611 flows through the inside of rotating drum 660 and is heated by the hot syngas that flows on the outside of drum 660 and on the inside of drum enclosure 662 as shown by flow curves 647. While flowing through the rotating heated drum 660, the feed 611 is ground to a fine powder and most of the liquids are vaporized. The solids from this prepared plasma feed flow out outlet bulkhead nozzle 678 and the vapors flow out outlet 658 of inlet bulkhead 663. The solids stream 612 flows to plasma contacting chamber 610, where it reacts with the plasma and forms molten metals, silicate slag, and syngas 620 as previously described. Syngas 620 flows from collecting chamber 621 through outlet 628, cyclone 630, venturi exhauster 640, and to drum enclosure 662 as previously described.

Syngas 620 then flows through conduit 648 to inlet 652 of recirculation blower 650. Syngas 620 flows from outlet 654 of blower 650 to driving fluid inlet 646 of exhauster 640. Recirculation blower 650 is used to increase the flow of gas around drum 660 and thereby improve the heat transfer rate. Exhauster 640 is used to blend the hot syngas 636 coming from reactor 601 with the cooler syngas coming from drum 660 (via conduit 648 and blower 650) to obtain a more manageable temperature, such as, for example, less than 2000° F. Excess syngas is drawn off selectively from outlet stream 654 of blower 650 by stream 637, which is controlled by control valve 656. Control valve 656, well known by those familiar with the art, is usually controlled by the desired temperature of prepared feed 612 before feed 612 enters mixing chamber 610.

The vapors and gases produced inside of drum 660 flow through outlet 658 of inlet bulkhead 663 to inlet 674 of venturi scrubber 670. The vapors and gases then flow to container 693 through venturi scrubber outlet 676, with liquids collecting in the bottom of container 693 and gases flowing out outlet 672 to inlet 679 of scrubber 675. Gases in scrubber 675 flow through demister element 678 and out outlet 673, and liquids collect in the bottom of scrubber 675 and are selectively drained through outlet 677. Venturi driving fluid pump 680 pumps liquid from container 693 through pump inlet 671 and through outlet 682 to conduit 683. From conduit 683, the liquids pass through cooler 684 to venturi scrubber inlet 688. A side stream 691 can be drawn from the pump outlet 682 and becomes stream 696 that is controlled by control valve 692. Stream 696 can include hydrocarbons, dirt, and/or water, and can be removed for separation by any separation means known in the art, including but not limited to, gravity, centrifuge, or a water treating system. Clean makeup water is returned through inlet 698 of container 693, and liquid surface 695 is maintained and controlled by control valve 699 and level controller 697.

Figure 7:
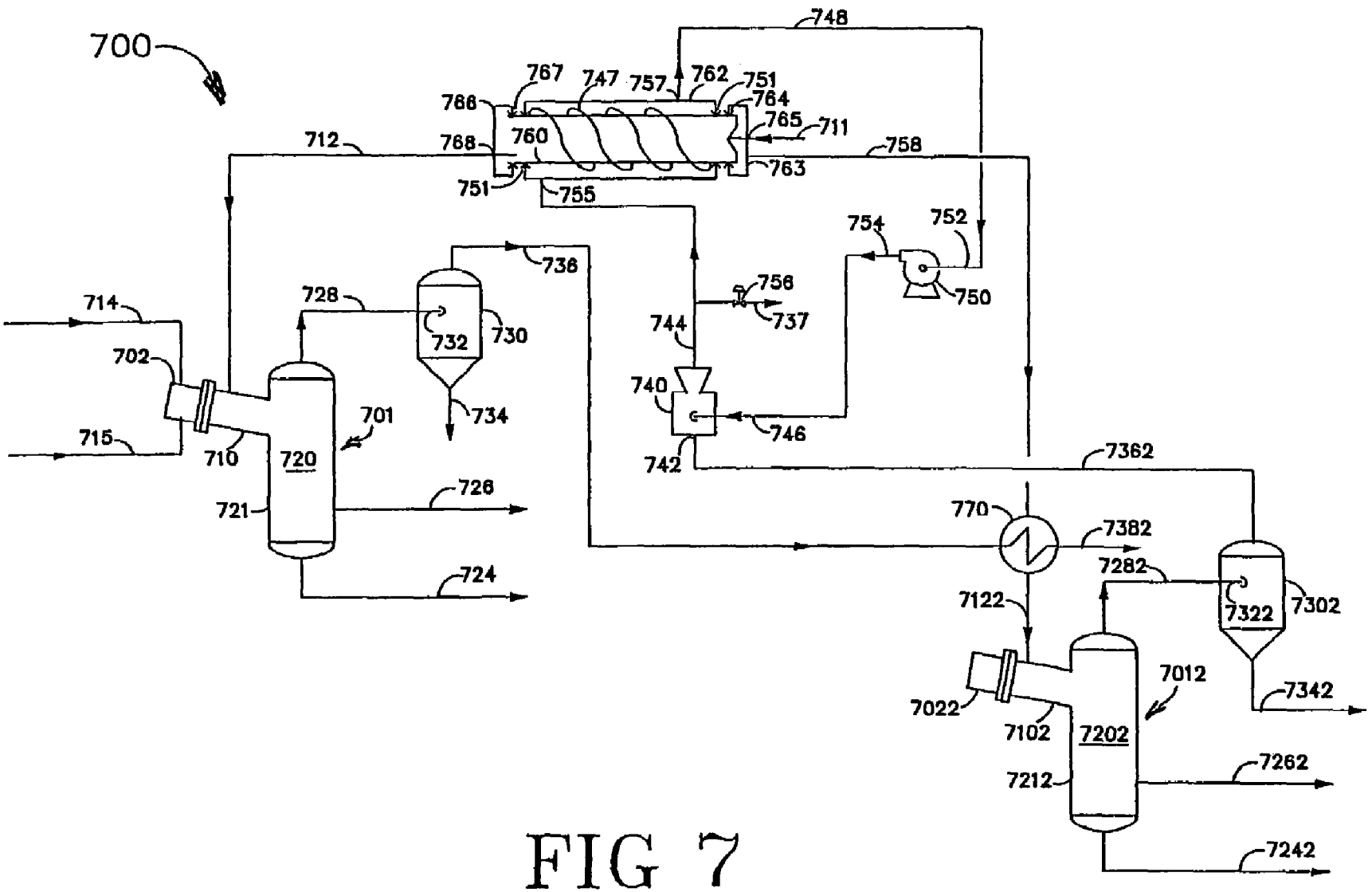
FIG. 7 shows a schematic view of an alternative waste processing plant using a rotating drum in series with two plasma reactors.

FIG. 7 is a schematic drawing of a further embodiment of the present invention. The apparatus of FIG. 7 is referred to as process plant 700. Plant 700 includes a first plasma reactor 701 having a collecting chamber 721, a contacting chamber 710, and a plasma torch 702 extending from contacting chamber 710 having inlets for a cooling and reforming medium supply 714 and electric supply 715. Molten metal flows out the bottom outlet 724 of chamber 721; silicate slag flows out outlet 726; and syngas 720 flows out top outlet 728. Syngas 720 flows into inlet 732 of cyclone 730, with the separated solids flowing out outlet 734 of cyclone 730 and clean syngas flowing out top outlet 736. Clean syngas 720 then flows through cross exchanger 770 to become cooler product syngas stream 7382.

Plant 700 also includes a second plasma reactor 7012 to process the vapors and gases formed in the drum 760. Plasma reactor 7012 comprises a collecting chamber 7212, a contacting chamber 7102, and a plasma torch 7022 having an electric power supply and a supply of reforming and cooling medium (not shown). Gases to be reformed flow from outlet 758 of inlet bulkhead 763 through cross exchanger 770 and into inlet 7122 of contacting chamber 7102. Collecting chamber 7212 includes molten metal outlet nozzle 7242, slag outlet nozzle 7262, and syngas outlet nozzle 7282. Syngas 7202 flows from the collecting chamber 7212 through outlet 7282 to inlet nozzle 7322 of cyclone 7302. The separated solids collected by cyclone 7302 flow out nozzle 7342 and clean syngas flows out nozzle 7362 to inlet 742 of venturi exhauster 740. Plant 700 allows solids to be processed by the first plasma reactor 701 and the relatively clean gas feed to be processed by the second plasma reactor 7012.

Rotatable drum 760 of plant 700 is attached to stationary inlet bulkhead 763 by seals 764 and attached to stationary outlet bulkhead 766 by seals 767. Seals 764 and 767 separate the inside of drum 760 from the outside. Drum 760 is configured such that feed 711 placed through the inlet bulkhead opening 765 progresses through drum 760 to the solids outlet opening 768, and the vapors and gases produced inside of the heated and rotating drum 760 flow out the vapor outlet 758 of inlet bulkhead 763. Drum 760 is enclosed by stationary enclosure 762 and attached by seals 751. Enclosure 762 is provided with hot gas inlet 755 and hot gas outlet 757 so that hot gas flows from the inlet to the outlet as shown by curves 747 and heats drum 760.

Feed material 711 flows through the inside of rotating drum 760 and is heated by hot syngas 7202 that flows between the outside of drum 760 and the inside of drum enclosure 762, as shown by flow curves 747. While flowing through rotating heated drum 760, waste 711 is ground to a fine powder and most of the liquids are vaporized, with the solids from this prepared plasma feed flowing out bulkhead outlet 768 and the vapors flowing out outlet 758 of inlet bulkhead 763. The prepared solids stream 712 flows to plasma contacting chamber 710. Syngas 720 flows from collecting chamber 721 through outlet 728 into cyclone 730, and then via outlet 736 to cross exchanger 770 forming product stream 7382 as previously described.

Syngas 7202 flowing around drum 760 according to curves 747 flows through outlet 757 and conduit 748 to inlet 752 of recirculation blower 750. Syngas 7202 then flows from blower outlet 754 to driving inlet 746 of venturi exhauster 740 and out outlet 744 of exhauster 740. Cooler syngas 7202 has now been blended with hot syngas 7202, and is returned to inlet 755 of drum enclosure 762. Recirculation blower 750 is used to increase the flow of gas around drum 760 thereby improving the heat transfer rate. Exhauster 740 is used to blend the hot syngas 7202 coming from reactor 7012 with the cooler syngas coming from drum 760 to obtain a more manageable temperature in the range of, for example, less than 2000° F. Excess blended syngas is drawn off selectively from outlet stream 744 of exhauster 740 by stream 737, which is controlled by control valve 756. Control valve 756, well known by those familiar with the art, is usually controlled by the desired temperature of prepared feed stream 712 before feed 712 enters mixing chamber 710.

Although the present invention and its advantages have been described in relation to the specifically illustrated embodiments, it should be understood that various changes, substitutions and alterations can be made without departing from the spirit and scope of the invention as defined by the claims. The following are some examples of such substitutions:

The hot syngas 7202 from reactor 7012 used to heat drum 760 of FIG. 7 may be substituted with syngas 720 from reactor 701.

A vessel with spray nozzles can be used to clean and/or cool the various gas streams, instead of a venturi scrubber. Also, there are many other known methods of cleaning and cooling gas streams.

Gas rotary lock valves or screw conveyors in the transfer lines between the drum and the reactors are not shown in the drawings, since they may or may not be required for different feeds and different modes of operation. Gas rotary lock valves and screw conveyors are well known by those familiar with the art.

Certain of the vessels in the plants described herein require internal refractory insulation and the use of particular materials to provide protection from the intense hot streams. Such methods of heat protection are well known by those familiar with the art and are not described herein.

The above discussion is meant to be illustrative of the principles and various embodiments of the present invention. While the preferred embodiments of the invention and their methods of use have been shown and described, modifications thereof can be made by one skilled in the art without departing from the spirit and teachings of the invention. The embodiments described herein are exemplary only, and are not limiting. Many other variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims. In particular, unless order is explicitly recited, the recitation of steps in a claim is not intended to require that the steps be performed in any particular order, or that any step must be completed before the beginning of another step.

What is claimed is:

1. An apparatus for processing a waste product comprising:

a rotatable drum having an inlet end and an outlet end with said inlet end attached to an inlet bulkhead by a first seal and said outlet end attached to an outlet bulkhead by a second seal; said drum configured such that a material placed in said drum via an opening in said inlet bulkhead flows from said drum via an outlet opening in said outlet bulkhead; and wherein said seals separate the inside of said drum from the outside; and an enclosure disposed about said drum having an inlet end with an enclosure inlet opening and an outlet end with an enclosure outlet opening for circulating hot gas over the outside of said drum to heat the material in said drum;

a plasma reactor connected to said drum outlet bulkhead opening for receiving and processing said waste material from said drum; said reactor having a gas removal opening connected to said drum enclosure inlet opening for removing the gas created by said reactor, and at least one other opening for removing molten material from said reactor; and a recirculation blower, having a blower inlet connected to said drum enclosure outlet opening and a blower outlet connected to said gas removal opening of said plasma reactor for blending said created reactor gas with the gas circulated around said drum.

2. The apparatus of claim 1 including a cyclone connected to said gas removal opening to remove solids from said created gas.

3. The apparatus of claim 1 including a venturi exhauster having a driving fluid inlet connected to said blower outlet, a feed inlet connected to said gas removal opening and an exhauster outlet connected to said enclosure inlet to assist in drawing said reactor gas from said reactor and blending said reactor gas with said circulated gas.

4. The apparatus of claim 1 including a controllable source of cooling and/or reforming medium suitably connected to said reactor.

5. An apparatus for processing a waste product comprising:

a rotatable drum having an inlet end and an outlet end with said inlet end attached to an inlet bulkhead by a first seal and said outlet end attached to an outlet bulkhead by a second seal; said inlet bulkhead having a waste inlet opening for flowing said waste product to the inside of said drum and a vapor outlet opening for removing gas from said drum, and said outlet bulkhead having a solids outlet opening for removing the solid material in said drum and a hot gas inlet opening for receiving a hot gas; said drum being configured such that the solid waste material flowing through said waste inlet opening flows from the inlet end of said drum to said solids outlet opening and such that hot gas flowing through said hot gas inlet opening flows through said drum to heat said waste in said drum, and flows out said gas outlet opening; said seals separating the inside of said drum from the outside;

a plasma reactor connected to said solids outlet opening for receiving and processing said solid material from said drum; said reactor having a gas removal opening connected to said hot gas inlet opening for removing the gas created by said reactor, and at least one other opening for removing the molten material from said reactor;

a conduit connected to said vapor outlet opening in said inlet bulkhead for receiving said hot gas from said reactor and the vapors created from said waste and conducting them out of said drum.

6. The apparatus of claim 5 wherein the outlet of said conduit flows through a venturi scrubber connected to said conduit for scrubbing said hot gas and vapors, and wherein the outlet of said scrubber is connected to a container for collecting the liquids and gasses from said scrubber, and wherein a pump is connected to said container for removing and recirculating liquids in said container to a driving fluid inlet in said Venturi scrubber.

7. The apparatus of claim 5 including a controllable source of cooling and/or reforming medium suitably connected to said reactor.

8. The apparatus of claim 6 including an air cooler connected between the outlet of said pump and said Venturi scrubber for cooling said re-circulated liquid.

9. The apparatus of claim 7 including a demister element in said container for removing free liquid droplets from said gasses.

10. The apparatus of claim 7 including a controllable stream outlet in said container, connected to a centrifuge, for removing a side stream of said liquid and separating said side stream into solids, oil and water; said centrifuge having a controllable water line connected to said container for maintaining a desired level in said container.

11. The apparatus of claim 5 including means to supply additional external heat to said drum.

12. An apparatus for processing a waste product comprising:

a rotatable drum having an inlet end and an outlet end with said inlet end attached to an inlet bulkhead by a first seal and said outlet end attached to an outlet bulkhead by a second seal; said inlet bulkhead having a waste inlet opening for flowing said waste product to the inside of said drum and a gas outlet opening for removing gas from said drum, and said outlet bulkhead having a solids outlet opening for removing the solid material in said drum and a hot gas inlet opening for receiving a hot gas; said drum being configured such that the solid waste material flowing through said waste inlet opening flows from the inlet end of said drum to said solids outlet opening and hot gas flowing through said hot gas inlet opening flows through said drum to heat said waste in said drum and flows out said gas outlet opening in said inlet bulkhead; said seals separating the inside of said drum from the outside;

a first plasma reactor connected to said solids outlet opening for receiving and processing said solid material from said drum; said reactor having a first gas removal opening connected to said hot gas inlet opening of said drum outlet bulkhead for removing the gas created by said first reactor, and at least one other opening for removing the molten material from said first reactor;

a second plasma reactor, having a first conduit connected to said gas outlet opening of said inlet bulkhead, for receiving and processing said gasses from said outlet opening; said second reactor having a second gas removal opening and at least one other opening for removing the molten material from said second reactor;

a second conduit, connected to said second reactor gas outlet opening for receiving said hot gas from said reactor.

13. The apparatus of claim 12 wherein said second conduit includes a cyclone for removing solids in the hot gas flowing through said conduit.

14. The apparatus of claim 12 including a controllable source of cooling and/or reforming medium suitably connected to said first and second reactors.

15. The apparatus of claim 12 including a cross exchanger positioned in said first and second conduit to heat said drum gas from said drum and cool said hot gas from said cyclone.

16. An apparatus for processing a waste product comprising:

a rotatable drum having an inlet end and an outlet end with said inlet end attached to an inlet bulkhead by a first seal and said outlet end attached to an outlet bulkhead by a second seal; said drum configured such that a material placed through an opening in said inlet bulkhead flows from the inlet through a solids outlet opening in said outlet bulkhead and the vapors and gasses created in said drum flow out a gas outlet opening in said inlet bulkhead; said seals separating the inside of said drum from the outside;

an enclosure disposed about said drum having an inlet end with an enclosure inlet opening and an outlet end with an enclosure outlet opening for circulating hot gas over the outside of said drum to heat the material in said drum;

a plasma reactor connected to said solids outlet opening for receiving and processing the solid waste material from said drum; said reactor having a gas removal opening connected to said drum enclosure inlet opening for removing the reactor gas created by said reactor, and at least one other opening for removing molten material from said reactor;

a recirculation blower having a blower inlet connected to said drum enclosure outlet opening and a blower outlet connected to said gas removal opening of said reactor for blending said created gas with the gas circulated around said drum; and a first conduit connected between said blower and said drum enclosure for selectively removing said circulated gas from said apparatus;

a second conduit connected to said gas outlet opening in said inlet bulkhead for collecting said vapors and gasses from in said drum.

17. The apparatus of claim 16 including a cyclone suitably positioned in the line of said reactor gas removal opening to remove solids in said reactor gas.

18. The apparatus of claim 17 including a venturi exhauster having a driving fluid inlet connected to said blower outlet, a feed inlet connected to the outlet of said cyclone and an exhauster outlet connected to said enclosure inlet.

19. The apparatus of claim 16 including a controllable source of cooling and/or reforming medium suitably connected to said reactor.

20. The apparatus of claim 16 including a venturi scrubber connected to said conduit, for scrubbing said hot gas and vapors, having a container connected to the outlet of said scrubber, for collecting the liquids and gasses from said scrubber, and a pump, connected to said container, for removing and recirculating said container liquid to a driving fluid inlet in said Venturi scrubber; said container having a gas outlet for removing the gasses collected in said container.

21. The apparatus of claim 19 including a demister element in said gas outlet of said container for removing free liquid droplets from said gasses.

22. The apparatus of claim 19 including an air cooler connected between the outlet of said pump and said Venturi scrubber for cooling said re-circulated liquid.

23. The apparatus of claim 19 including a controllable liquid outlet in said container for selectively removing the liquid collected in said container.

24. The apparatus of claim 19 including a controllable liquid supply line for maintaining a selected liquid level in said container.

25. An apparatus for processing a waste product comprising:

a rotatable drum having an inlet end and an outlet end with said inlet end attached to an inlet bulkhead by a first seal and said outlet end attached to an outlet bulkhead by a second seal; said drum configured such that a material placed in said drum via an opening in said inlet bulkhead flows from said drum via a solids outlet opening in said outlet bulkhead and the drum gasses created in said drum flow out of said drum via a gas outlet opening in said inlet bulkhead; said seals separating the inside of said drum from the outside;

an enclosure disposed about said drum having an inlet end with an enclosure inlet opening and an outlet end with an enclosure outlet opening for circulating hot gas over the outside of said drum to heat the material in said drum;

a first plasma reactor connected to said solids outlet opening for receiving and processing the solid waste material from said drum; said reactor having at least a first opening for removing molten material from said reactor; and having a second opening connected to a first conduit for removing the reactor gas created by said first reactor;

a second plasma reactor having a second conduit connected to said gas outlet opening for receiving and processing said drum gasses from said drum; said second reactor having a third gas removal opening connected by a third conduit to said enclosure inlet opening for removing the hot gas created by said second reactor, and having at least a fourth opening for removing the molten material from said second reactor;

a recirculation blower, having a blower inlet connected to said drum enclosure outlet opening and a blower outlet connected to said third conduit for blending gas created in said second reactor with the gas circulated over said drum;

a fourth conduit connected between said blower and said drum enclosure for selectively removing said circulated gas from said apparatus.

26. The apparatus of claim 25 including a cyclone positioned in said first conduit to remove solids from said reactor gas.

27. The apparatus of claim 25 including a cyclone positioned in said third conduit to remove solids from said second reactor gas.

28. The apparatus of claim 26 including a venturi exhauster having a driving fluid inlet connected to said blower outlet, a feed inlet connected to the outlet of said cyclone, and an exhauster outlet connected to said drum enclosure inlet.

29. The apparatus of claim 25 including a controllable source of cooling and/or reforming medium suitably connected to said first and second reactors.

30. The apparatus of claim 25 including a cross exchanger positioned in said first and second conduits to heat said drum gas from said drum and cool said first reactor gas.

* * * * *